US006110298A

United States Patent [19]

Senda et al.

[11] Patent Number: 6,110,298

[45] Date of Patent: Aug. 29, 2000

[54] GRAIN-ORIENTED ELECTRICAL STEEL SHEET EXCELLENT IN MAGNETIC CHARACTERISTICS AND PRODUCTION PROCESS FOR SAME

[75] Inventors: Kunihiro Senda; Toshito Takamiya; Michiro Komatsubara, all of Okayama, Japan

[73] Assignee: Kawasaki Steel Corporation, Japan

[21] Appl. No.: 09/116,757

[22] Filed: Jul. 16, 1998

[30] Foreign Application Priority Data

Jul. 17, 1997 [JP] Japan ..... 9-192255

[51] Int. Cl.[7] ..... C21D 8/12; C22C 38/02

[52] U.S. Cl. ..... 148/308; 148/111; 148/112

[58] Field of Search ..... 148/308, 651, 148/111, 112

[56] References Cited

FOREIGN PATENT DOCUMENTS

| | | |
|---|---|---|
| 0 047 129 | 3/1982 | European Pat. Off. . |
| 0 438 592 | 7/1991 | European Pat. Off. . |
| 0 588 342 | 3/1994 | European Pat. Off. . |
| 0 716 151 | 6/1996 | European Pat. Off. . |
| 50-35679 | 11/1975 | Japan . |
| 54-040223 | 3/1979 | Japan . |
| 57-02252 | 1/1982 | Japan . |
| 59-177349 | 10/1984 | Japan . |
| 59-197520 | 11/1984 | Japan . |
| 61-117218 | 6/1986 | Japan . |
| 61-139007 | 6/1986 | Japan . |
| 62-096617 | 6/1987 | Japan . |
| 2-20693 | 5/1990 | Japan . |
| 3-39968 | 6/1991 | Japan . |
| 6-089805 | 3/1994 | Japan . |
| 6-100996 | 4/1994 | Japan . |
| 6-37694 | 5/1994 | Japan . |
| 6-80172 | 10/1994 | Japan . |
| 8-049045 | 2/1996 | Japan . |
| 8-213225 | 8/1996 | Japan . |
| 8-288115 | 11/1996 | Japan . |

*Primary Examiner*—Deborah Yee
*Attorney, Agent, or Firm*—Austin R. Miller

[57] ABSTRACT

Grain-oriented electrical steel sheet having excellent magnetic characteristics in which shearing angles of grain directions [001] of secondary recrystallized grains from a rolling direction have an average value of about 4° or less, wherein the area % of secondary recrystallized grains having a length of about 60 mm or more in the rolling-orthogonal direction is about 85% or more; with respect to recrystallized micro grains, the area % of crystal grains having a grain diameter of 2 to 20 mm is about 0.2% or more and about 10% or less; and the average value of angles formed with the steel sheet surface by grain directions [001] is about 1.5° or more and about 5.0° or less; in a grain-oriented electrical steel sheet of a high magnetic flux density ($B_8 \geqq 1.96$ T) low iron loss is achieved without providing magnetic domain-refining treatment, very low iron loss value by forming grooves on the steel sheet surface, smoothening the steel sheet surface or a combination thereof.

10 Claims, 5 Drawing Sheets

GRAIN-ORIENTED ELECTRICAL STEEL SHEET EXCELLENT IN MAGNETIC CHARACTERISTICS AND PRODUCTION PROCESS FOR SAME

BACKGROUND OF THE INVENTION

1. Field of the Invention

This invention relates to a low iron loss grain-oriented electrical steel sheet suitable for cores of transformers and other electrical equipment.

2. Description of the Related Art

Grain-oriented electrical steel sheets used for cores of transformers and other electrical equipment require excellent magnetic characteristics, particularly low iron loss. This iron loss is usually represented as the sum of hysteresis loss and eddy current loss. In order to reduce iron loss, one or both of hysteresis loss and eddy current loss need to be reduced.

Hysteresis loss has sometimes been reduced to a large extent by highly orienting crystal grains of a steel sheet in a so-called Goss direction, that is, the {110}<001>direction, to enhance magnetic permeability. This has been done by using an inhibitor to inhibit the growth of crystal grains. On the other hand, eddy current loss has been reduced by increasing Si content in a steel sheet, or making the sheet thinner, or reducing the grain diameter of secondary recrystallized grains or forming a tension coating on a metal surface, or combinations of these.

Further, narrowing of magnetic domains artificially has reduced eddy current loss in recent years, and irradiating with laser rays (Japanese Examined Patent Publication No. 57-2252) and plasma flame (Japanese Unexamined Patent Publication No. 62-96617) have also been disclosed. In addition, for heat-proof domain-refining, grooves are formed on a steel sheet after secondary recrystallization by mechanical processing (Japanese Examined Patent Publication No. 50-35679) and linear notches orthogonal to the rolling direction are introduced before finishing annealing (Japanese Examined Patent Publication No. 3-39968). Further, disclosed in Japanese Unexamined Patent Publication No. 59-177349 is a method in which eddy current loss is reduced by appropriately controlling the inclination angle of crystals in the <001> direction from a rolling surface to reduce the widths of magnetic domains.

It has been intended, in conventional techniques, to integrate crystal grains into the Goss direction in order to reduce hysteresis loss and to reduce magnetic domain width in order to lower eddy current loss.

However, the conventional iron loss-reducing techniques suffer problems so that the iron loss has not yet sufficiently been reduced. The reasons include:

(1) iron loss increases due to non-uniform distribution of magnetic flux density originating in a difference (particularly a difference in the rolling plane) between grain directions of secondary recrystallized grains which are adjacent to each other in a direction orthogonal to the rolling direction (sometimes referred to as the rolling-orthogonal direction);

(2) when secondary recrystallized grains have a small diameter, the formation of magnetic poles originating in a difference between grain directions of the respective crystal grains reduces magnetic permeability and increases hysteresis loss; and (3) as grain directions approach the Goss direction, the magnetic pole amount coming out on the steel sheet surface is lowered, and magnetic domain is broadened, so that eddy current loss becomes larger.

A method attempting to prevent degradation of iron loss has been disclosed in Japanese Unexamined Patent Publication No. 8-49045 by the present inventors. In that method the local change of magnetic flux density is made uniform over the whole steel sheet. A method involving controlling the composition of the coating, and the aspect ratio of secondary recrystallized grains, has been disclosed in Japanese Unexamined Patent Publication No. 8-288115 by the present inventors for practicing this technique. These methods can reduce uneven distribution of magnetic flux density originating in a difference between $\alpha$ angles (shearing angles in the [001] direction from the rolling direction in the rolling plane) of secondary crystallized grains adjacent in a rolling-orthogonal direction by inhibiting the growth of the secondary recrystallized grains in the rolling direction and accelerating the growth of secondary recrystallized grains in the rolling-orthogonal direction. However, when the secondary recrystallized grains in the rolling-orthogonal direction have large grain diameters, the growth rate of the secondary recrystallized grains in the rolling direction is likely to be accelerated as well. As a result, a suitable aspect ratio has not been attainable depending on the materials, and the iron loss has not sufficiently been reduced in some certain cases.

The artificial magnetic domain-refining method described above is effective against the problem (2) described above, but this magnetic domain-refining treatment brings about a degradation of magnetic permeability at the same time. Accordingly, it is difficult to reduce sufficiently a magnetic domain width without deteriorating magnetic permeability when depending only on conventional magnetic domain-refining techniques.

Further, with respect to the problem of item (3) described above, disclosed in Japanese Unexamined Patent Publication No. 6-89805 is a method in which fine grains having a diameter of 5 mm or less in addition to coarse secondary recrystallized grains are allowed to be present only in a prescribed number within a prescribed direction. However, this has not solved the problem of item (1) and therefore has faced the problem that when magnetic flux density is unevenly distributed in a plane of a sheet, due to a direction difference between secondary recrystallized grains adjacent in a rolling-orthogonal direction, the desired iron loss-reducing effect cannot be obtained.

SUMMARY OF THE INVENTION

An object of the present invention is to provide a high magnetic permeability grain-oriented steel sheet which is substantially not reduced in magnetic flux density, and has a low iron loss, and which has excellent magnetic characteristics, and a production process for the same. This invention advantageously overcomes the problems described above in reference to the prior art.

We have intensively researched the form of secondary recrystallized grains which provide a uniformizing effect of magnetic flux, together with the magnetic domain-refining effect, even when the secondary recrystallized grains have grown in a rolling direction to some extent. As a result, we have found that distribution and grain direction of specific recrystallized grains are capable of maximum iron loss-reducing effect, regardless of the presence of magnetic domain-refining treatment, without causing degradation of magnetic flux density, in a high magnetic permeability grain-oriented steel sheet.

The present invention relates to a grain-oriented electrical steel sheet having excellent magnetic characteristics which comprises about 2.0 to 5.0 mass % of Si and about 0.0003 to 0.1 mass % of one or the total of two or more kinds of As, Sb and Bi and in which shearing angles from the rolling direction of grain directions [001], of secondary recrystallized grains, have an average value of about 4° or less. Further with respect to distribution of the secondary recrystallized grains having a large grain diameter, the secondary recrystallized grains having a maximum length of about 60 mm or more in the rolling-orthogonal direction have an area occupancy of about 85% or more. Further, with respect to recrystallized grains having a small grain diameter, crystal grains having a grain diameter falling in a range of about 2–20 mm have an area occupancy of about 0.2% to about 10%. Still further, the average value (area average value) of angles formed by the grains with the steel sheet surface, according to the grain directions [001] of the crystal grains having a grain diameter falling in a range of about 2–20 mm falls in a range of about 1.5°–5.0°.

In the present invention, it is preferable, for the purpose of reducing the iron loss of the sheet by magnetic domain-refining, to provide on the surface of the sheet a group of linear grooves which are arranged at an angle of about 30° or less to the rolling-orthogonal direction of the sheet, the grooves each having a depth of about 10 $\mu$m or more, a width of about 20–300 $\mu$m and a groove spacing of about 1 mm or more.

Further, in the present invention it is preferable, for reducing iron loss by reducing the hysteresis loss, to provide no forsterite coating on the steel sheet surface.

The following drawings are illustrative but are not intended to define or to limit the scope of the invention.

DESCRIPTION OF THE PREFERRED EMBODIMENTS

Figure 1:
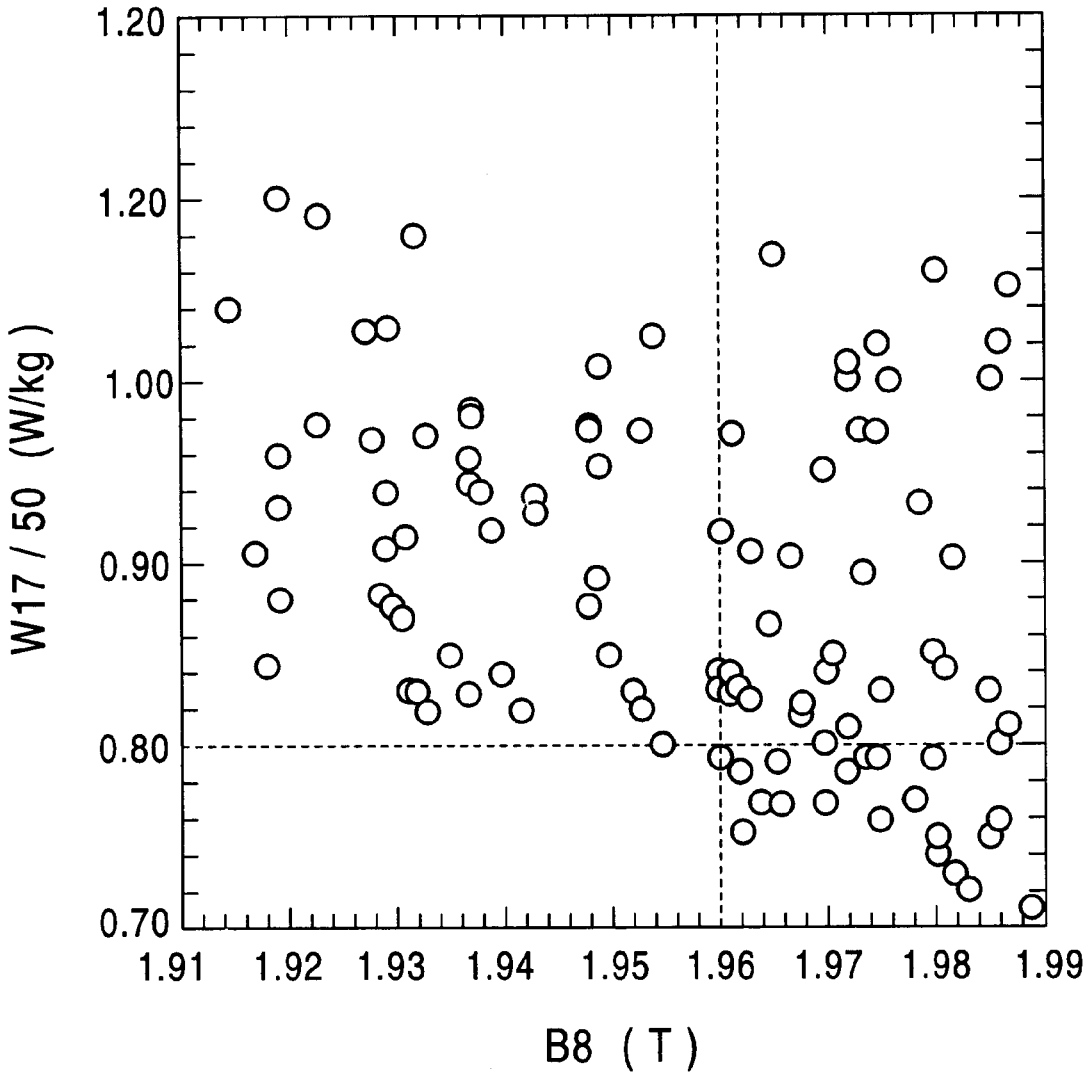
FIG. 1 is a graph showing a relationship between magnetic flux density $B_8$ and the iron loss $W_{17/50}$.

For clarity of explanation we refer preliminarily to relevant experiments conducted in relation to the invention. These experiments are illustrative and do not define or limit the scope of the invention, which is defined in the appended claims.

A silicon containing steel small ingot (100 kg) having a composition of C 0.063 mass % (mass % is hereinafter represented merely as%), Si 3.20%, Mn 0.065%, Se 0.020%, Al 0.022%, N 0.0090%, Mo 0.020%, Sb 0.050% and Bi 0.02% and the balance mainly Fe, was induction-heated to a temperature of 1450° C. and then hot-rolled to a hot-rolled sheet having a thickness of 2.4 mm. This hot-rolled sheet was subjected to hot-rolled sheet annealing (1050° C. for 40 seconds in nitrogen) and then subjected to primary cold rolling to a cold-rolled sheet having a thickness of 1.7 mm. Then, after intermediate annealing (1000° C. for 2 minutes in wet hydrogen), the sheet was subjected to secondary cold rolling to a final cold-rolled sheet thickness of 0.23 mm.

Next, the cold rolled sheet was subjected to decarburization annealing at 850° C. for 2 minutes, and then the decarburization annealed sheet was subjected to stress-introducing treatment at a rolling reduction of 0.1%. Thereafter, an annealing separator comprising MgO as a principal component was applied to the sheet surface, and the steel sheet was subjected to final finishing annealing at 1200° C., where the steel sheet was subjected to secondary recrystallized grain nucleus-forming treatment by holding at a temperature of 850° C. for 20 hours. After the final finishing annealing, an insulation coating comprising colloidal silica and magnesium phosphate as principal components was applied to the final finishing annealed sheet.

A single sheet test piece having a width of 100 mm and a length of 280 mm was sampled from the steel sheet thus obtained and measured for iron loss $W_{17/50}$ and magnetic flux density $B_8$. After measuring, the respective test pieces were subjected to macro-etching to cause secondary recrystallized grains to come out. The sizes of the respective secondary recrystallized grains were measured by means of image analysis, and their grain directions were measured by the Laue method.

In the present invention, the average value (area average value) of angles formed with the steel sheet surface by the grain directions [001] of the crystal grains having grain diameters falling in a range of about 2–20 mm means an average of values obtained by multiplying the values of angles which the respective grain directions [001] form with the sheet surface by area rates of the crystal grains having grain diameters of 2–20 mm to the whole area.

Further, the expression crystal grain diameter (R) means the diameter of a circle circumscribing the grain, and is indicated by the following equation (1):

$$R=2(S/\pi)^{1/2} \quad (1)$$

wherein S is a grain area.

These measurement results shall be described below.

FIG. 1 is a graph showing the relationship of the magnetic flux density $B_8$ and the iron loss $W_{17/50}$ in the respective test pieces.

As will be apparent from FIG. 1, as the magnetic flux density $B_8$ grows higher, the optimum value of the iron loss $W_{17/50}$ becomes lower, and with a $B_8$ value of 1.96 T or more, the $W_{17/50}$ values can even be lower than 0.80 W/kg. On the other hand, in some cases the sheet had such inferior iron loss that the $W_{17/50}$ exceeded 0.95 W/kg, while the $B_8$ was as high as 1.96 T or more. Such degradation of iron loss in a high magnetic flux density area has been found to be caused by the fact that the magnetic pole amount on the steel sheet surface is decreased by reduction of shearing angle (hereinafter referred to as the β angle) of grain direction [001] from the rolling plane and the magnetic domain width grows large.

Accordingly, the relation of an average β angle with the iron loss $W_{17/50}$ was investigated in samples having $B_8$ values of 1.96 T or more, wherein values obtained by multiplying β angles of the respective secondary recrystallized grains measured by the Laue method with the respective area portions thereof were integrated to obtain an average β angle.

Figure 2:
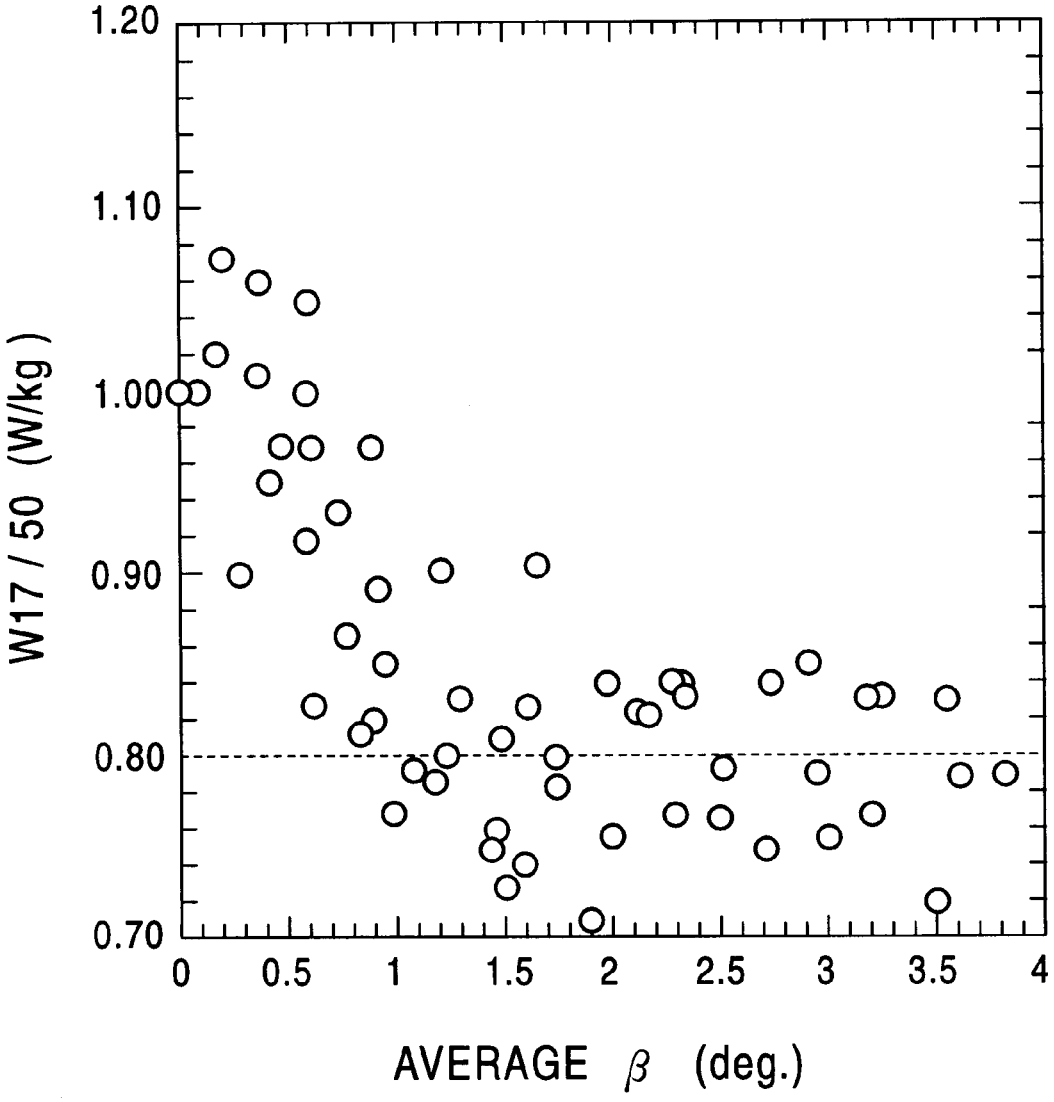
FIG. 2 is a graph showing a relationship between average β angle and iron loss $W_{17/50}$.

The result is shown in FIG. 2, which is a graph showing the relationship of the average β angle and the iron loss $W_{17/50}$. The relationship where the iron loss decreases as the average β angle increases is graphically observed in FIG. 2. However, the relationship is still somewhat scattered. Accordingly, in materials having high magnetic flux density $B_8$ of about 1.96 T or more, it is Judged to be essentially impossible to reduce the iron loss to 0.80 W/kg or less by controlling only the average β angle. Further, in the samples having $B_8$ values of 1.96 T or more, the relationship of average secondary recrystallized grain diameter with iron loss was investigated, but no clear relationship was observed.

On the basis of these investigative results, we discovered that a rise of uniformity of magnetic flux density distribution in a plane of the sheet could be a factor effecting iron loss, and that an angle other than average β angle and average grain diameter may be effective for reducing iron loss.

Figure 3:
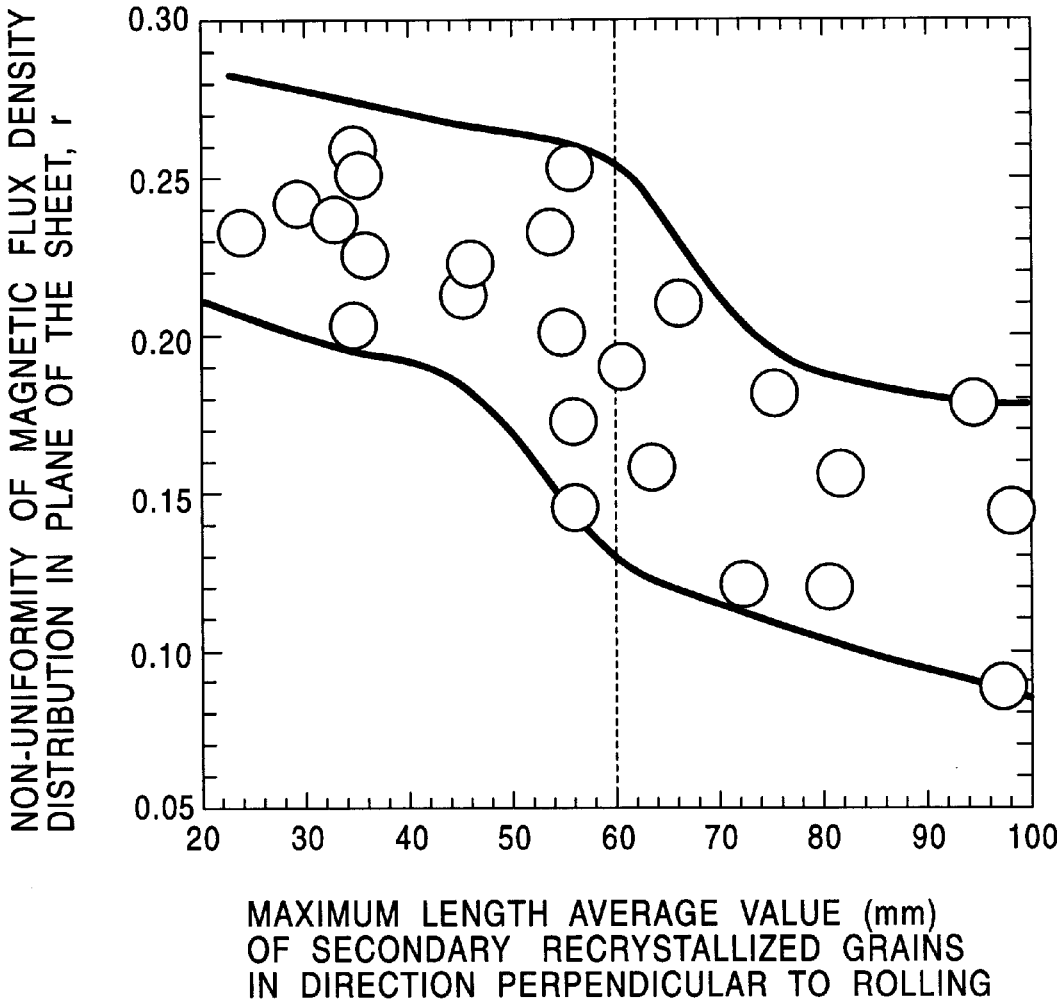
FIG. 3 is a graph showing relationships between average values of maximum lengths of the secondary recrystallized grains (grain diameter: 20 mm or more) in the rolling-orthogonal direction and non-uniformity of local magnetic flux density in a plane of the sheet.

Shown in FIG. 3 is a graph based upon further work, and showing relationships between the average values of the maximum lengths of the secondary recrystallized grains (grain diameter: about 20 mm or more) in the rolling-orthogonal direction and non-uniformity of the local magnetic flux density in a plane of the sheet.

The non-uniformity r of a local magnetic flux density is defined by the following equation (2). The local magnetic flux density $Bi^{local}$ was determined by a needle probe method in an area of 100 mm of the whole width of the steel sheet, and of 200 mm in the rolling direction, with the number of probes (N) being set to 200 points. The width of a magnetic flux density-measuring portion was 10 mm, and the pitch was 10 mm in either the a rolling direction or the rolling-orthogonal direction. The magnetic flux density Bm for exciting the whole steel sheet, while measuring magnetic flux density in this local area, was set at 1.0 T. The equation is:

$$r = (1/N)\sum_{i=1}^{N}(B_i^{local} - B_m)/B_m \tag{2}$$

It will be observed from FIG. 3 that when the average value of the maximum lengths of the secondary recrystallized grains in the rolling-orthogonal direction is about 60 mm or more, the degree of non-uniformity r of the local magnetic flux density tends to be reduced.

Accordingly, we investigated the relationship of the proportion in the steel sheet of secondary recrystallized grains having a maximum length of about 60 mm or more in the rolling-orthogonal direction, and compared this proportion with the resulting degree of non-uniformity r of the magnetic flux density in a plane of the sheet. Further, crystal grains having relatively small grain diameters of 2 to 20 mm were classified into levels according to the average β angles. The grain diameter was shown by the circle-corresponding diameter defined by the equation (1) already discussed herein.

Figure 4:
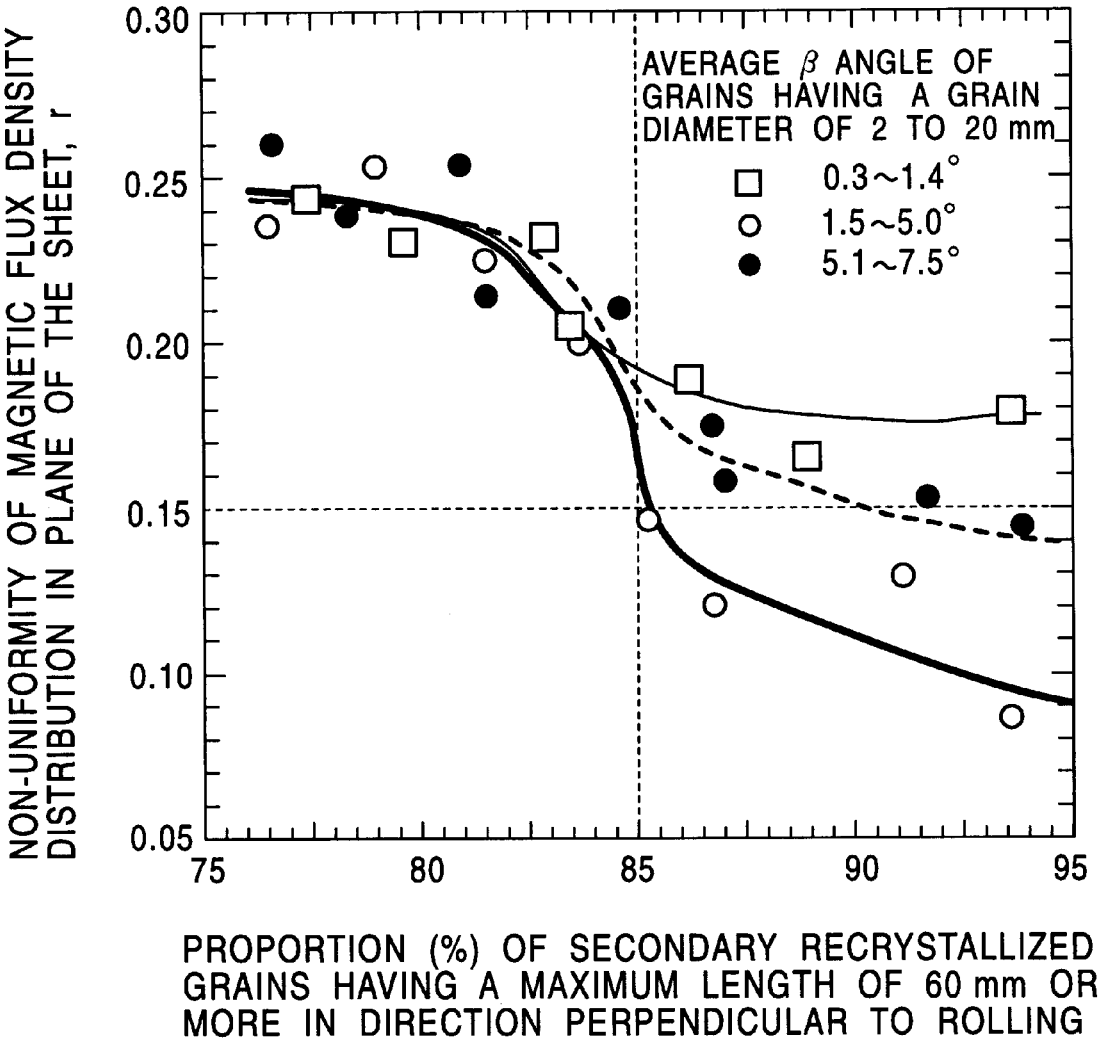
FIG. 4 is a graph showing relationships of proportions of secondary recrystallized grains having a maximum length of 60 mm or more in the rolling-orthogonal direction in the whole steel sheet and non-uniformity of local magnetic flux density in a plane of the sheet, in which the average β angle of the crystal grains having a grain diameter of about 2 to 20 mm is a parameter.

The results of this investigation are shown in FIG. 4 of the drawings. FIG. 4 is a graph showing the relationship of the proportion of secondary recrystallized grains, having a maximum length of about 60 mm or more, in the rolling-orthogonal direction, in the whole steel sheet, and compares it with the degree of non-uniformity of local magnetic flux density in a plane of the sheet. The crystal grains having grain diameters of about 2 to 20 mm were classified into levels according to their average β angles.

As is apparent from FIG. 4, we have found that when the proportion in the whole sheet of secondary recrystallized grains having a maximum length of 60 mm or more, in the rolling-orthogonal direction, is about 85% or more, and the crystal grains having a grain diameter of about 2 to 20 mm had an average β angle of about 1.5 to 5.0°, the degree of non-uniformity r of the local magnetic flux density in a plane of the sheet defined by the equation (2) described above was about 0.15 or less. Accordingly, the iron loss-reducing effect required that r is small.

Accordingly, we gave special attention to the proportion of secondary recrystallized grains having a maximum length of about 60 mm or more in the rolling-orthogonal direction, in the whole steel sheet, in relation to the average β angle of the grains having a grain diameter of about 2 to 20 mm, and compared these factors against the iron losses of test pieces having $B_8$ values of about 1.96 T or more.

Figure 5:
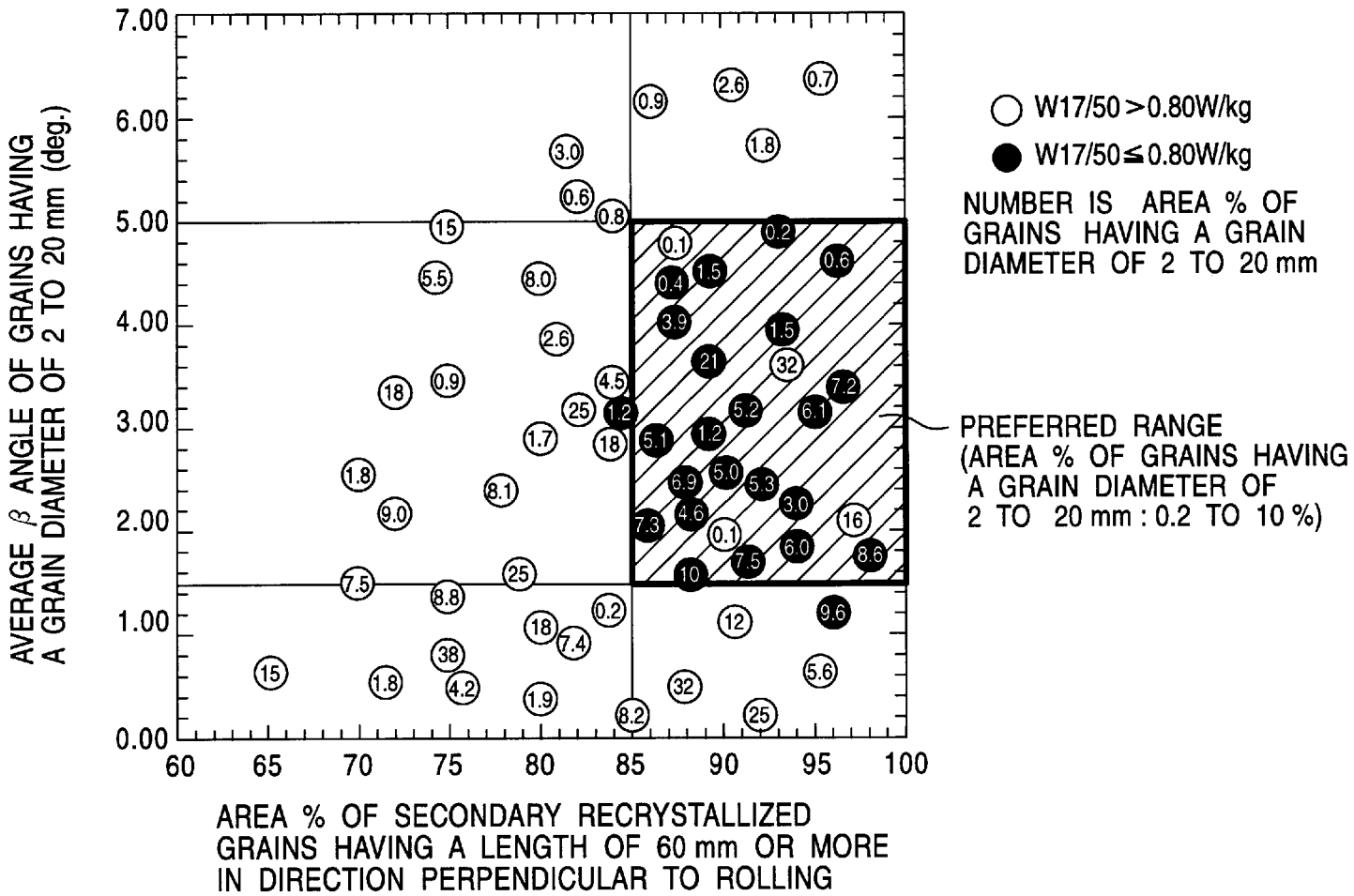
FIG. 5 is a graph showing a relationship between the proportion of secondary recrystallized grains having a maximum length of about 60 m or more in the rolling-orthogonal direction in the whole steel sheet, in conjunction with the average β angle of the crystal grains having a grain diameter of about 2 to 20 mm and the proportion of crystal grains having a grain diameter of about 2 to 20 mm in the whole steel sheet, and compared this proportion with the iron loss $W_{17/50}$ of the steel sheet.

FIG. 5 is a graph showing a relationship between the proportion of secondary recrystallized grains having a maximum length of about 60 mm or more in the rolling-orthogonal direction in the whole steel sheet, in conjunction with the average β angle of the crystal grains having a grain diameter of about 2 to 20 mm and the proportion of crystal grains having a grain diameter of about 2 to 20 mm in the whole steel sheet, and compared this proportion with the iron loss $W_{17/50}$ of the steel sheet.

As is apparent from FIG. 5, a low iron loss of $W_{17/50} \leqq 0.80$ W/kg can be obtained on the conditions that the secondary recrystallized grains having a maximum length of about 60 mm or more in the rolling-orthogonal direction have an area occupancy of about 85% or more, and that the crystal grains having a grain diameter of about 2 to 20 mm have an average β angle of about 1.5 to 5°, and that the crystal grains having a grain diameter of about 2 to 20 mm have an area occupancy of about 0.2 to 10%.

Next, the present invention shall be explained in relation to important ingredients of the steel sheet.

Si is important as a component for raising the specific resistance and reducing the eddy current loss of the sheet. If the Si content is too low, this effect is insufficient. The Si content has to be about 2.0% or more. On the other hand, too much Si content makes rolling difficult. The upper limit thereof is about 5.0%.

It is effective for obtaining a high magnetic flux density to include one or more of As, Sb and Bi, which are SB group elements, as an inhibitor effect reinforcing component. Further, coarsening of the secondary recrystallized grains is accelerated by adding one or more of As, Sb and Bi and makes it easy to obtain secondary recrystallized grains which are rather long in the rolling-orthogonal direction. With respect to the necessity of the lower limits of the contents of these components, it is considered that in order to continue to maintain a normal grain growth-inhibitor effect up to a high temperature region in secondary recrystallization annealing to form secondary recrystallized grains having a high integration degree over the whole steel sheet, these components should remain in high temperature region as much as possible. Accordingly, it is considered that good magnetic characteristics are obtained when small amounts of these components remain in the product sheet. However, when these components are present in excess in the product sheet, an increase of precipitates causes an increase of hysteresis loss. Accordingly, as a condition for obtaining a high magnetic flux density without increasing hysteresis loss, the contents of As, Sb and Bi have a lower limit of about 0.0003% and an upper limit of about 0.1% in terms of the total.

An object of the present invention is to obtain stably a low iron loss in a grain-oriented electrical steel sheet having a large secondary recrystallized grain diameter and a very high direction integration degree. In the case of a grain-oriented electrical steel sheet having a low direction integration, the iron loss can be reduced simply by refining the large secondary recrystallized grain diameters. Accordingly, as a precondition for reducing the iron loss by uniformizing the magnetic flux density in the present invention, the shearing angle θ (angle formed between the rolling direction and the [001] direction of the crystal grains) in an average grain direction of the steel sheet is set to about 4° or less. The method for determining the average grain direction θ is not specifically restricted, and the method using a measured value of magnetic flux density $B_8$ is available as a simple method. If the $B_8$ value is about 1.94 T or more when magnetic domain-refining treatment is not provided, the shearing angle of the grain direction is about 4° or less. Further, the grain direction can directly be determined by the known X ray Laue method. In this case, the method for determining θ includes determination of directions of secondary recrystallized grains, multiplying them with the area percentages, and averaging them, and measuring directions at lattice points having a pitch of about 5 to 20 mm to obtain a simple average.

Limitation on the area percentages of the secondary recrystallized grains having a maximum length of about 60 mm or more in the rolling-orthogonal direction and limitation on the β angle of crystal grains having a grain diameter of about 2 to 20 mm are conditions for uniformizing local magnetic flux density distribution in the inside of the steel sheet, as shown in FIG. 4, and reducing the iron loss by this means. An increase in lengths of the secondary recrystallized grains in the rolling-orthogonal direction can inhibit, as is the case with Japanese Unexamined Patent Publication No. 8-288115 described above, an uneven magnetic flux density originating in a difference in the α angles (angle formed by the [001] direction and the rolling direction within the rolling plane) of the secondary recrystallized grains adjacent in the rolling-orthogonal direction from being produced and can reduce the iron loss.

The reason for the effect brought about by the β angle of the crystal grains having a grain diameter of about 2 to 20 mm, present in a range of about 1.5 to 5.0°, is not apparent. However, it is believed that even when the secondary recrystallized grains occupying a large part of the steel sheet are elongated in a rolling direction, non-uniformity of magnetic flux density distribution is relieved by the presence of micrograms in which the grain β angle deviates slightly from those of crystal grains present in the circumference thereof. Further, it is considered that magnetic domains are refined without bringing about a reduction of magnetic flux density by magnetic poles produced in a grain boundary between micro grains having a β angle of about 1.5 to 5.0° and coarse grains having a β angle close to about 0°. The grain diameter of about 2 mm or more uniformizes magnetic flux distribution and refinement of magnetic domain. However, the grain diameter of grains larger than about 20 mm brings about a reduction of magnetic flux density, and therefore the grain diameter of the micro grains in this invention is restricted to a range of about 2 to 20 mm. With respect to the area percentage occupied by the micro grains, when it is about 0.2% or more, a uniform magnetic flux is obtained, but if it exceeds about 10%, the danger of causing non-uniformity in magnetic flux distribution is rather pronounced, so that the area rate is limited to a range of about 0.2% or more and about 10% or less.

When an average value of the β angles is smaller than about 1.5° or exceeds about 5.0°, the effect of uniformizing magnetic flux distribution is not obtained as shown in FIG. 4, and therefore it is restricted to a range of about 1.5 to about 5.0°.

The micro grains having a grain diameter of about 2 to 20 mm described above may be either secondary recrystallized grains or modified primary recrystallized grains. The iron loss can further be reduced by artificially forming fine grains which have smaller grain diameters than those of the micro grains having a grain diameter of about 2 to 20 mm, and in which the grain directions are random in the inside of the grain-oriented electrical steel sheet of the present invention, and therefore such technique is advantageous when used in combination.

A reduction of iron loss by uniformizing magnetic flux density distribution can be achieved by satisfying the conditions described above. Such effect is brought about by a mechanism different from a conventional reduction of iron loss obtained by refining of magnetic domains. A combination of both can synergistically reduce iron loss and achieve a low iron loss that has never before been obtained. Accordingly, in order to reduce the iron loss by refining the magnetic domains in the present invention, there is preferably provided on the steel sheet surface a linear groove group comprising linear grooves forming an angle of less than about 30° with the rolling-orthogonal direction of the steel sheet and having a depth of about 10 μm or more, a groove width of about 20–300 μm and a groove spacing of about 1 mm or more.

With respect to the depth and the width of the linear grooves, when the depth is less than about 10 μm and the width is less than about 20 μm, a satisfactory magnetic pole-forming amount is not obtained, and the magnetic domains are not sufficiently refined. Accordingly, the depth is set to about 10 μm or more and the width is set to about 20 μm or more. With respect to the upper limit of the width of the grooves, a groove width exceeding about 300 μm brings about a deterioration of magnetic permeability. The width is accordingly limited to about 300 μm or less. With respect to the groove spacing, a spacing of less than about 1 mm brings about deterioration of magnetic permeability. Therefore, the spacing is set to about 1 mm or more. The upper limit thereof is set preferably to about 30 mm to obtain the effect of refining the magnetic domains. With respect to the angle of the linear grooves, if the angle to the direction orthogonal to the rolling direction exceeds about 30°, the magnetic domain-refining effect is reduced, and therefore the angle is restricted to about 30° or less.

A method disclosed in Japanese Unexamined Patent Publication No. 59-197520 has been employed to form the grooves on the steel sheet before finishing annealing. When forming the grooves on the steel sheet after finishing annealing, stress relief annealing was carried out after applying a load on the steel sheet to form the grooves. This method is disclosed in Japanese Unexamined Patent Publication No. 61-117218.

In the present invention, it is preferable, for reducing the iron loss by reduction of hysteresis loss, that a forsterite coating is not present on the steel sheet surface.

If significant forsterite were present on the steel sheet surface, a forsterite anchor penetrating into a metal interface would allow the hysteresis loss to grow. Accordingly, the hysteresis loss can be reduced by preventing substantial forsterite coating from being formed on a metal surface, or by removing a forsterite coating after it has been formed. The iron loss can further be reduced by baking a tension-providing coating on the steel. A reduction of iron loss by uniformizing the magnetic flux density is carried out through a different mechanism from reduction of hysteresis loss. Accordingly, the grain-oriented electrical steel sheet of the present invention, in which a forsterite coating is preferably not present on the steel sheet surface, makes it possible to provide a further lower iron loss than those of low iron loss materials produced by conventional methods by which a forsterite coating is prevented from being present. Further better products having low iron losses can be obtained by subjecting materials having no forsterite coatings on steel sheet surfaces to polishing treatment or grain direction-intensifying treatment disclosed in Japanese Examined Patent Publication No. 6-37694, and therefore such technique is preferable when used in combination.

The material components used for producing the grain-oriented electrical steel sheet of the present invention (other than Si, As, Sb and Bi) shall not specifically be restricted, and C, Mn, S, Se, Al, N, Mo, Cu, P and Sn may be added if necessary.

C is a useful component for improving the microstructure of the steel after hot rolling by making use of transformation, and should be added in an amount of about 0.005% or more. However, an amount exceeding about 0.080% causes inferior decarburization in decarburization annealing and therefore is not preferred.

Mn not only contributes effectively to improvement in hot working properties of steel but also forms deposits such as MnS and MnSe when S or Se is present. This functions as an inhibitor. Accordingly, Mn is added preferably in a range of about 0.03 to about 0.20%.

Further, it is effective as well for obtaining good magnetic characteristics to add Al, N, S and Se as inhibitors to the steel. Addition of Al and N to the steel allows them to deposit in the form of AlN, which acts as an inhibitor and is effective for controlling the growth of normal grains. In this case, Al is added preferably in the form of soluble Al in a range of about 0.010 to 0.050%. N is added preferably in a content of about 0.005 to 0.015%.

Similarly, S and Se are deposited in the form of MnS and MnSe and function as inhibitors. The suitable contents are about 0.005 to 0.020% for S and about 0.01 to 0.04% for Se.

In addition, the following components can be added in order to reinforce inhibitor effect: Mo, Cu, P and Sn.

Cu is a component which is bonded to Se and S to form deposits to reinforce inhibitor effect as is the case with Mn. Cu is notably effective in a range of about 0.01 to 0.30%.

P is a component which segregates in a grain boundary and reinforce inhibitor effect, as is the case with Sb. The amount of less than about 0.010% provides a poor addition effect. On the other hand, the amount exceeding about 0.030% makes the magnetic characteristics and the surface property unstable. Accordingly, the amount is preferably about 0.010 to 0.030%.

Mo integrates secondary recrystallized grains direction in the Goss direction, and is added preferably in a range of about 0.005 to 0.20%.

Sn segregates in a grain boundary and has the effect of reinforcing inhibitor effect, as is the case with Sb. It is markedly effective in a range of about 0.010 to 0.10%.

Among the respective components described above, C, S, Se, N and Al are removed after displaying their respective functions; C is removed mainly by decarburization annealing; and S, Se, N, Al and P are removed by purification annealing in the latter half of finishing annealing. Accordingly, they only remain in trace or incidental amounts in the metal of the product.

Next, preferred conditions for producing the grain-oriented electrical steel sheet of the present invention shall be explained.

Slab-Heating Temperature: 1250° C. or Higher

In production it is important to completely turn the inhibitor components of deposit dispersion type, contained in the steel, into solid solutes by heating the slab to produce finely dispersed inhibitors such as MnSe, MnS, $Cu_{2-x}Se$, $Cu_{2-x}S$ and AlN in a subsequent hot rolling step. If this condition is not satisfied, coarsened primary grains are produced before the inhibitor effect of As, Sb, Bi and the like become effective during final finishing annealing, and before the magnetic characteristics are deteriorated. Accordingly, the slab should be heated at temperatures of 1250° C. or higher.

Hot Rolling Temperature: 900° C. or Higher

When the temperature of a slab or a hot rolled sheet has been lowered too much during completion of slab-heating through the completion of finish hot rolling, inhibitors contained in the steel are deposited coarsely, and coarsened primary grains are produced before the inhibitor effect is manifested by As, Sb, Bi and the like during final finishing annealing. Then the magnetic characteristics of the steel are deteriorated. Accordingly, hot rolling should be carried out at temperature range of about 900° C. or higher.

Hot Rolled Sheet-Annealing Temperature: about 800° C. to about 1100° C. and Annealing Time: about 20 to about 300 Seconds Hot rolled sheet annealing is an important step for homogenizing a hot rolled sheet microstructure, and for controlling deposition of inhibitors such as AlN. If hot rolled sheet annealing is carried out at temperatures lower than about 800° C. for time shorter than about 20 seconds, the microstructure and the effect of controlling the inhibitors are unsatisfactory. On the other hand, if the temperature of about 1100° C. and the time of 200 seconds are exceeded, the inhibitors are coarsened, and the magnetic characteristics become unstable. Accordingly, the ranges described above should be carefully maintained.

Intermediate Annealing Temperature: about 800° C. to about 1150° C. and Annealing Time: about 20 to about 300 Seconds A major object of intermediate annealing is to control the microstructure by recrystallization after pre-cold rolling as well as controlling deposition of carbides in the steel and the dispersion condition of deposition type inhibitors. In the present invention, the strength of the deposition type inhibitors has to be matched with an inhibitor effect strengthening action as contributed by one or more of As, Sb and Bi as described above. Therefore, the intermediate annealing temperature and annealing time have to be properly controlled. If the intermediate annealing temperature is about 800° C. or lower and the time is about 20 seconds or shorter, the strength of the deposition type inhibitors is too large, and secondary grains having deviated grain directions are produced in large quantities. On the other hand, if the temperature exceeds about 1150° C. and the time exceeds about 300 seconds, the deposition type inhibitors are degraded to bring about inferior secondary recrystallization. Accordingly, the intermediate annealing temperature and the annealing time should be maintained within the ranges of about 800 to about 1150° C. and about 20 to about 300 seconds, respectively in the present invention.

Cold Rolling Temperature: about 150° C. or Higher and Roll Outlet Tension: about 25 to 45 kg/mm$^2$ (Minimum 1 Pass or More)

An object of the present invention is to achieve a reduction of iron loss by controlling non-uniformity of magnetic flux density in a plane of the sheet, caused by coarsening of secondary grains. Therefore, it is required to control the width of the secondary grains in the rolling-orthogonal direction to about 60 mm or more and to cause prescribed refined grains to be present in the steel sheet in a prescribed area percentage.

Controlling cold rolling temperature and roll outlet tension is a condition required for forming good refined grains. When the roll outlet tension is less than about 25 kg/mm$^2$, the area percentage of grains having a grain diameter of about 2 to 20 mm is less than about 0.2%, or the average β angle of micro grains is less than about 1.5° in some cases. Further, if the roll outlet tension exceeds about 45 kg/mm$^2$, the area percentage of such refined grains exceeds about 10% or an average β angle of micro grains exceeds about 5.0° in some cases. Further, when the rolling temperature is lower than about 150° C. even if the rolling tension falls in a range of about 25 to 45 kg/mm$^2$, refined grains are subject to change of texture. Accordingly, in order to satisfy the conditions for the refined grains in the present invention, it is required to set the maximum temperature in cold rolling to about 150° C. or higher and the roll outlet tension to about 25 to 45 kg/mm$^2$ (minimum 1 pass or more).

Shot Blast Treatment to Decarburized Annealed Steel

In addition to proper control of rolling tension, it is effective as well to form the refined grains described by subjecting the steel to a shot blast treatment to provide it with microstress. The steel is provided with local microstress by causing micro rigid bodies to strike against the decarburized annealed steel, whereby micro grains are produced at the beginning of finishing annealing to form micro grains having a grain diameter of about 2 to 20 mm as described herein.

Finishing Annealing Temperature: about 1130° C. or Higher and Annealing Time: about 5 Hours or Longer In finishing annealing, an annealing temperature of about 1130° C. or higher and an annealing time of about 5 hours or longer are required, after finishing secondary recrystallization, for removing impurities such as Al, N, S and Se contained in a steel sheet and reducing iron loss by improving hysteresis loss.

EXAMPLES OF THE INVENTION

Example 1

Induction-heated to a temperature of 1450° C. were 20 bars (codes 1A to 1T) of steel slabs containing C 0.065%, Si 3.20%, Mn 0.065%, Se 0.025%, Al 0.025%, N 0.0090%, Mo 0.025%, Sb 0 to 0.05%, Bi 0 to 0.05% and As 0 to 0.05% and comprising the balance range of mainly Fe, and then they were hot-rolled at temperature range exceeding 1000° C. to prepare hot-rolled sheets having a thickness of 2.4 mm. These hot-rolled sheets were subjected to hot-rolled sheet annealing at 1050° C. for 40 seconds in nitrogen and then to primary cold rolling to prepare cold-rolled sheets having a thickness of 1.7 mm. Subsequently, after subjecting them to intermediate annealing (1000° C. for 2 minutes in wet hydrogen), they were subjected to secondary cold rolling to a final cold-rolled sheet thickness of 0.23 mm. A rolling tension at a roll outlet side in final 5 passes in the secondary cold rolling was set to 20 to 50 kg/mm$^2$, and a rolling temperature was set to 50 to 250° C. in a stationary part.

Subsequently, after subjecting the cold rolled sheets to decarburization annealing at 850° C. for 2 minutes, an annealing separator comprising MgO as a principal component was applied thereon, and then they were rolled up in the form of coils and subjected to final finishing annealing at a temperature of 1200° C. In this final finishing annealing, the steel sheets were subjected to secondary recrystallized nucleus-forming treatment by temperature stabilization at 850° C. for 20 hours. After completing the final finishing annealing, an insulation coating comprising colloidal silica and magnesium phosphate as principal components were provided on the steel sheets.

Epstein test pieces were sampled from the respective steel sheets thus obtained and measured for iron loss $W_{17/50}$ and magnetic flux density $B_8$. Further, test pieces were sampled and subjected to macro-etching to cause secondary recrystallized grains to appear. Then, the forms of the respective secondary recrystallized grains were determined by means of image analysis, and the grain directions of the respective secondary recrystallized grains were measured by the aforementioned Laue method. Further, the product sheets were analyzed for metal components.

Shown together in Table 1 are measurement results of the metal components, the forms of the secondary recrystallized grains, the grain directions and the magnetic characteristics (magnetic flux density $B_8$ and iron loss $W_{17/50}$) of the grain-oriented electrical steel sheet products obtained above. The Examples are within, and the Comparative Examples are outside, the scope of the invention.

TABLE 1

| Sample code | Tensile force of final 5 passes in secondary cold rolling (kg/mm$^2$) | Steel sheet temperature in cold rolling (° C.) | Metal components of product (mass %) | | | Area percentage of secondary grains having a maximum width of 60 mm or more in rolling direction (%) | Area percentage of grains having a grain diameter of 2 to 20 mm (%) | Area percentage average β of grains having a grain diameter of 2 to 20 mm (deg.) | $B_8$ (T) | $W_{17/50}$ (W/kg) | Remarks |
|---|---|---|---|---|---|---|---|---|---|---|---|
| | | | As | Sb | Bi | | | | | | |
| 1A | 20 | 250 | 0 | 0 | 0 | 55 | 21 | 3.9 | 1.931 | 0.95 | Comp. Ex. |
| 1B | 40 | 250 | 0 | 0 | 0 | 63 | 18 | 4.2 | 1.928 | 0.98 | Comp. Ex. |
| 1C | 50 | 250 | 0.0004 | 0.02 | 0 | 86 | 0.10 | 6.2 | 1.962 | 0.89 | Comp. Ex. |
| 1D | 40 | 250 | 0.0004 | 0.02 | 0 | 87 | 0.5 | 3.0 | 1.965 | 0.79 | Example |
| 1E | 20 | 250 | 0 | 0.001 | 0.0002 | 85 | 0.1 | 4.5 | 1.962 | 0.93 | Comp. Ex. |
| 1F | 40 | 250 | 0 | 0.001 | 0.0002 | 86 | 1.1 | 3.5 | 1.963 | 0.79 | Example |
| 1G | 20 | 250 | 0.001 | 0 | 0.0005 | 89 | 0.12 | 5.5 | 1.972 | 0.90 | Comp. Ex. |
| 1H | 40 | 250 | 0.001 | 0 | 0.0005 | 92 | 3.9 | 2.0 | 1.976 | 0.78 | Example |
| 1I | 40 | 250 | 0 | 0.0003 | 0.0002 | 90 | 6.6 | 4.0 | 1.975 | 0.78 | Example |

TABLE 1-continued

| Sample code | Tensile force of final 5 passes in secondary cold rolling (kg/mm$^2$) | Steel sheet temperature in cold rolling (° C.) | Metal components of product (mass %) As | Sb | Bi | Area percentage of secondary grains having a maximum width of 60 mm or more in rolling direction (%) | Area percentage of grains having a grain diameter of 2 to 20 mm (%) | Area percentage average β of grains having a grain diameter of 2 to 20 mm (deg.) | $B_8$ (T) | $W_{17/50}$ (W/kg) | Remarks |
|---|---|---|---|---|---|---|---|---|---|---|---|
| 1J | 50 | 250 | 0 | 0.0003 | 0.0002 | 89 | 4.2 | 6.2 | 1.961 | 0.91 | Comp. Ex. |
| 1K | 40 | 250 | 0.0002 | 0.0003 | 0 | 93 | 6.8 | 2.0 | 1.980 | 0.76 | Example |
| 1L | 50 | 250 | 0.0002 | 0.0003 | 0 | 91 | 7.8 | 5.9 | 1.969 | 0.91 | Comp. Ex. |
| 1M | 40 | 250 | 0 | 0.03 | 0.0003 | 89 | 6.9 | 3.5 | 1.982 | 0.73 | Example |
| 1N | 50 | 250 | 0 | 0.03 | 0.0003 | 88 | 12.2 | 3.0 | 1.975 | 0.89 | Comp. Ex. |
| 1O | 25 | 250 | 0 | 0.05 | 0.02 | 91 | 3.7 | 2.4 | 1.980 | 0.74 | Example |
| 1P | 20 | 250 | 0 | 0.05 | 0.02 | 90 | 0.17 | 0.5 | 1.982 | 0.95 | Comp. Ex. |
| 1Q | 40 | 250 | 0 | 0.05 | 0.02 | 90 | 6.2 | 1.9 | 1.979 | 0.76 | Example |
| 1R | 45 | 250 | 0 | 0.05 | 0.02 | 93 | 2.4 | 4.7 | 1.976 | 0.76 | Example |
| 1S | 50 | 250 | 0 | 0.05 | 0.02 | 91 | 3.6 | 6.7 | 1.971 | 0.83 | Comp. Ex. |
| 1T | 20 | 250 | 0.01 | 0.04 | 0.04 | 92 | 0.60 | 0.6 | 1.976 | 0.93 | Comp. Ex. |
| 1U | 40 | 250 | 0.01 | 0.04 | 0.04 | 91 | 6.0 | 4.1 | 1.969 | 0.79 | Example |
| 1V | 20 | 250 | 0.03 | 0.03 | 0.03 | 95 | 0.09 | 0.4 | 1.965 | 0.90 | Comp. Ex. |
| 1X | 40 | 50 | 0 | 0.05 | 0.02 | 96 | 0.10 | 4.9 | 1.983 | 0.86 | Comp. Ex. |
| 1Y | 40 | 100 | 0 | 0.05 | 0.02 | 95 | 0.15 | 3.3 | 1.981 | 0.84 | Comp. Ex. |
| 1Z | 40 | 150 | 0 | 0.05 | 0.02 | 93 | 0.9 | 3.6 | 1.983 | 0.79 | Example |

Comp. Ex.: Comparative Example

As is apparent from the results shown in Table 1, all the grain-oriented electrical steel sheets prepared in the examples of the present invention, though not subjected to magnetic domain-refining treatment, have very excellent magnetic characteristics.

Example 2

Induction-heated to a temperature of 1450° C. were 15 bars (codes 2A to 2P) of steel slabs containing C 0.067%, Si 3.30%, Mn 0.068%, Se 0.023%, Al 0.022%, N 0.0085%, Mo 0.020%, Sb 0.05% and Bi 0.04% and the balance mainly Fe, and then they were hot-rolled at temperature range exceeding 900° C. to prepare hot-rolled sheets having a thickness of 2.4 mm. These hot-rolled sheets were subjected to hot-rolled sheet annealing at 1050° C. for 40 seconds in nitrogen and then to primary cold rolling to prepare cold-rolled sheets having a thickness of 1.7 mm. Subsequently, after subjecting them to intermediate annealing (1000° C. for 2 minutes in wet hydrogen), they were subjected to secondary cold rolling to a final cold-rolled sheet thickness of 0.23 mm. The steel sheet temperature was set to 250° C. in final 5 passes in this secondary cold rolling, and rolling tensions in the final 5 passes were set to three levels of 20 kg/mm$^2$ (code 2A), 40 kg/mm$^2$ (codes 2B to 2O) and 50 kg/mm$^2$ (code 2P).

Subsequently, linear grooves extending in a direction of 15° to the rolling-orthogonal direction were formed on the steel sheet surfaces (one side) by resist etching. Accordingly, the cold rolled coils produced from the steel sheets of the codes 2C, 2D, 2E and 2F were set to a groove depth of 5 to 25 μm, a groove width of 50 μm and a groove space of 4 mm; those of the codes 2G, 2H, 2I and 2J were set to a groove depth of 12 μm, a groove width of 10 to 400 μm and a groove spacing of 5 mm; and those of the codes 2K, 2L, 2M, 2N, 2O and 2P were set to a groove depth of 18 μm, a groove width of 100 μm and a groove spacing of 0.5 to 5 mm. No grooves were formed on sheets bearing the codes 2A and 2B.

Subsequently, after subjecting the cold rolled sheets to decarburization annealing at 850° C. for 2 minutes, an annealing separator comprising MgO as a principal component was applied thereon, and the sheets were rolled up in the form of coils and subjected to final finishing annealing at a temperature of 1200° C. In this final finishing annealing, the steel sheets were subjected to secondary recrystallized nucleus-forming treatment by temperature stabilization at 850° C. for 20 hours. After completing the final finishing annealing, an insulation coating comprising colloidal silica and magnesium phosphate as principal components were provided on the steel sheets.

Epstein test pieces were sampled from the respective steel sheets thus obtained and measured for iron loss $W_{17/50}$ and magnetic flux density $B_8$. Further, test pieces were sampled and subjected to macro-etching to cause secondary recrystallized grains to appear. Then, the forms of the respective secondary recrystallized grains were determined by image analysis, and the grain directions of the respective secondary recrystallized grains were measured by the Laue method.

Further, the product sheets were analyzed for metal components, and as a result, Sb 0.04% and Bi 0.02% remained in the metals of the product sheets.

Shown together in Table 2 are measurement results of the linear groove forms, the secondary recrystallized grain forms, the grain directions and the magnetic characteristics (magnetic flux density $B_8$ and iron loss $W_{17/50}$) of the grain-oriented electrical steel sheet products prepared above.

TABLE 2

| Sample code | Tensile force of final 5 passes in secondary cold rolling (kg/mm$^2$) | Linear groove conditions Depth (μm) | Width (μm) | Space (mm) | Shearing angle average value θ in crystallization direction (deg.) | Area percentage of secondary grains having a maximum width of 60 mm or more in rolling direction (%) | Area percentage of grains having a grain diameter of 2 to 20 mm (%) | Area percentage average β of grains having a grain diameter of 2 to 20 mm (deg.) | $B_8$ (T) | $W_{17/50}$ (W/kg) | Remarks |
|---|---|---|---|---|---|---|---|---|---|---|---|
| 2A | 20 | No groove | | | 2.0 | 89 | 0.1 | 1.2 | 1.980 | 0.92 | Comp. Ex. |
| 2B | 40 | No groove | | | 2.4 | 90 | 5.6 | 2.9 | 1.979 | 0.79 | Example |
| 2C | 40 | 5 | 50 | 4 | 2.2 | 89 | 0.3 | 3.5 | 1.978 | 0.77 | Example |
| 2D | 40 | 12 | 50 | 4 | 2.5 | 91 | 0.6 | 4.1 | 1.960 | 0.70 | Example |
| 2E | 40 | 18 | 50 | 4 | 3.2 | 90 | 0.5 | 3.6 | 1.930 | 0.65 | Example |
| 2F | 40 | 25 | 50 | 4 | 3.3 | 93 | 0.5 | 3.3 | 1.910 | 0.57 | Example |
| 2G | 40 | 12 | 10 | 5 | 2.4 | 92 | 2.5 | 3.6 | 1.968 | 0.78 | Example |
| 2H | 40 | 12 | 20 | 5 | 2.2 | 88 | 2.2 | 4.2 | 1.960 | 0.69 | Example |
| 2I | 40 | 12 | 100 | 5 | 2.9 | 90 | 3.0 | 3.5 | 1.956 | 0.65 | Example |
| 2J | 40 | 12 | 400 | 5 | 3.4 | 94 | 2.9 | 2.5 | 1.952 | 0.77 | Example |
| 2K | 40 | 18 | 100 | 0.5 | 2.1 | 92 | 6.0 | 3.6 | 1.910 | 0.82 | Example |
| 2L | 40 | 18 | 100 | 1.2 | 1.9 | 89 | 5.6 | 4.0 | 1.930 | 0.69 | Example |
| 2N | 40 | 18 | 100 | 3.0 | 2.8 | 90 | 8.0 | 2.9 | 1.945 | 0.59 | Example |
| 2O | 40 | 18 | 100 | 5.0 | 2.5 | 88 | 7.1 | 4.9 | 1.953 | 0.60 | Example |
| 2P | 50 | 18 | 100 | 5.0 | 2.3 | 86 | 10.6 | 6.9 | 1.950 | 0.88 | Comp. Ex. |

Comp. Ex.: Comparative Example

As is apparent from the results shown in Table 2, all the grain-oriented electrical steel sheets prepared as examples of the present invention have very excellent magnetic characteristics. Further, particularly low iron losses were obtained in the test pieces (2D, 2E, 2F, 2H, 2L, 2N and 2O) having linear groove groups in which the linear grooves were apart from each other at spacings of 1 mm or more.

Example 3

Induction-heated to a temperature of 1450° C. were 15 bars (codes 3A to 3P) of steel slabs containing C 0.065%, Si 3.20%, Mn 0.065%, Se 0.025%, Al 0.025%, N 0.0090%, Mo 0.025%, Sb 0 to 0.05%, Bi 0 to 0.05% and As 0 to 0.05% and comprising the balance of mainly Fe, and then they were hot-rolled at temperature range exceeding 950° C. to prepare hot-rolled sheets having a thickness of 2.4 mm. These hot-rolled sheets were subjected to hot-rolled sheet annealing at 1050° C. for 40 seconds in nitrogen and then to primary cold rolling to prepare cold-rolled sheets having a thickness of 1.7 mm. Subsequently, after subjecting them to intermediate annealing (1000° C. for 2 minutes in wet hydrogen), they were subjected to secondary cold rolling to a final cold-rolled sheet thickness of 0.23 mm. The steel sheets were rolled at a steel sheet temperature set to 200° C. and a rolling tension set to 40 kg/mm$^2$ in final 4 passes in this secondary cold rolling. Subsequently, the cold rolled sheets were subjected to decarburization annealing at 850° C. for 2 minutes.

Then, the decarburization annealed sheets of the codes 3B, 3D, 3F, 3H, 3J, 3L, 3O and 3P were subjected to stress-introducing treatment by shot blasting. Further, the coil of the code 3P was subjected to discharge treatment in the rolling direction and the rolling-orthogonal direction, respectively, in a lattice form at a pitch of 10 mm. The other remaining steel strips were not subjected to the treatment by shot blasting. Next, an annealing separator comprising MgO as a principal component was applied thereon, and then they were rolled up in the form of coils and subjected to final finishing annealing at a temperature of 1200° C. In the final finishing annealing, the steel sheets were subjected to secondary recrystallized nucleus-forming treatment by temperature stabilization at 850° C. for 20 hours. Next, forsterite coatings were removed from the steel sheets obtained after finishing annealing by sulfuric acid pickling, and then the surfaces thereof were polished by electrolysis, followed by providing the steel sheets with tension-providing insulation coatings of phosphate.

Epstein test pieces were sampled from the respective steel sheets thus obtained and measured for iron loss $W_{17/50}$ and a magnetic flux density $B_8$. Further, test pieces were sampled and subjected to macro-etching to allow secondary recrystallized grains to appear. Then, the forms of the respective secondary recrystallized grains were determined by means of image analysis, and the grain directions of the respective secondary recrystallized grains were measured by the Laue method. Further, the product sheets were analyzed for metal components.

Shown together in Table 3 are measurement results of the metal components, the forms of the secondary recrystallized grains, the grain directions and the magnetic characteristics (magnetic flux density $B_8$ and iron loss $W_{17/50}$) of the grain-oriented electrical steel sheet products obtained above.

TABLE 3

| Sample code | Shot blast treatment | Metal components of product (mass %) As | Sb | Bi | Area percentage of secondary grains having a maximum width of 60 mm or more in rolling direction (%) | Area percentage of grains having a grain diameter of 2 to 20 mm (%) | Area percentage average β of grains having a grain diameter of 2 to 20 mm (deg.) | $B_8$ (T) | $W_{17/50}$ (W/kg) | Remarks |
|---|---|---|---|---|---|---|---|---|---|---|
| 3A | None | 0 | 0 | 0 | 62 | 15 | 2.0 | 1.946 | 0.85 | Comp. Ex. |
| 3B | Done | 0 | 0 | 0 | 55 | 28 | 2.9 | 1.940 | 0.83 | Comp. Ex. |
| 3C | None | 0 | 0.03 | 0 | 87 | 0.1 | 1.2 | 1.962 | 0.86 | Comp. Ex. |
| 3D | Done | 0 | 0.03 | 0 | 86 | 0.3 | 2.1 | 1.960 | 0.73 | Example |
| 3E | None | 0.006 | 0.02 | 0 | 87 | 0.1 | 2.0 | 1.969 | 0.84 | Comp. Ex. |
| 3F | Done | 0.006 | 0.02 | 0 | 88 | 3.5 | 2.5 | 1.972 | 0.72 | Example |
| 3G | None | 0 | 0.02 | 0.0002 | 90 | 0.6 | 1.0 | 1.980 | 0.86 | Comp. Ex. |
| 3H | Done | 0 | 0.02 | 0.0002 | 92 | 5.6 | 2.3 | 1.985 | 0.70 | Example |
| 3I | None | 0 | 0.04 | 0.002 | 93 | 0.9 | 0.9 | 1.982 | 0.82 | Comp. Ex. |
| 3J | Done | 0 | 0.04 | 0.002 | 95 | 4.0 | 2.2 | 1.979 | 0.71 | Example |
| 3K | None | 0.01 | 0 | 0.001 | 89 | 0.05 | 3.5 | 1.971 | 0.85 | Comp. Ex. |
| 3L | Done | 0.01 | 0 | 0.001 | 87 | 0.25 | 4.6 | 1.973 | 0.70 | Example |
| 3N | None | 0.02 | 0.06 | 0.04 | 95 | 0.1 | 0.9 | 1.969 | 0.85 | Comp. Ex. |
| 3O | Done | 0.02 | 0.06 | 0.04 | 96 | 3.6 | 2.2 | 1.967 | 0.84 | Comp. Ex. |
| 3P | Done + discharge treatment | 0 | 0.04 | 0.002 | 93 | 4.8 | 2.5 | 1.963 | 0.68 | Example |

Comp. Ex.: Comparative Example

As is apparent from the results shown in Table 3, all the grain-oriented electrical steel sheets prepared in the examples of the present invention have very excellent magnetic characteristics.

Example 4

Induction-heated to a temperature of 1450° C. were 8 bars (codes 4A to 4H) of steel slabs containing C 0.066%, Si 3.40%, Mn 0.07%, Se 0.025%, Al 0.024%, N 0.0090%, Mo 0.025%, As 0.05% and Bi 0.04% and comprising a balance of mainly Fe, and then they were hot-rolled to prepare hot-rolled sheets having a thickness of 2.4 mm. These hot-rolled sheets were subjected to hot-rolled at temperature range exceeding 1000° C. sheet annealing at 1050° C. for 40 seconds in nitrogen and then to primary cold rolling to prepare cold-rolled sheets having a thickness of 1.7 mm. Subsequently, after subjecting them to intermediate annealing (1000° C. for 2 minutes in wet hydrogen), they were subjected to secondary cold rolling to a final cold-rolled sheet thickness of 0.23 mm. Before final 5 passes in this secondary cold rolling, the steel sheets were subjected to ageing treatment at 350° C. for 3 minutes, and the steel sheet temperature in the final 4 passes in the secondary cold rolling was set to 200° C. Subsequently, linear grooves with a depth of 25 μm, a width of 100 μm and a spacing of 1.5 mm extending in a direction forming 85° with the rolling direction were formed on the steel sheet surfaces (one side) of the codes 4E, 4F, 4G and 4H by means of resist etching. No grooves were formed on the other steel strips.

Subsequently, after subjecting the cold rolled sheets to decarburization annealing at 850° C. for 2 minutes, the steel sheets of the codes 4B, 4D, 4F and 4H were subjected to stress-introducing treatment by shot blast. Then, an annealing separator comprising $Al_2O_3$ as a principal component was applied on the steel sheets of the codes 4C, 4D, 4G and 4H. Further, an annealing separator comprising MgO as a principal component was applied on the steel sheets of the codes 4A, 4B, 4E and 4F. The steel sheets obtained after applying the annealing separator were rolled up in the form of coils and subjected to final finishing annealing at a temperature of 1200° C. In this final finishing annealing, the steel sheets were subjected to secondary recrystallized nucleus-forming treatment by temperature stabilization at 850° C. for 20 hours.

Forsterite was not formed on the steel sheets of the codes 4C, 4D, 4G and 4H on which the annealing separator comprising $Al_2O_3$ as a principal component was applied, and they had smooth metal surfaces as compared with those of the steel sheets on which forsterite was formed.

The steel sheets obtained after completing the final finishing annealing were provided with tension-providing insulation coatings of phosphate.

Epstein test pieces were sampled from the respective steel sheets thus obtained and measured for an iron loss $W_{17/50}$ and a magnetic flux density $B_8$. Further, test pieces were sampled and subjected to macro-etching to allow secondary recrystallized grains to appear. Then, the forms of the respective secondary recrystallized grains were determined by means of image analysis, and the grain directions of the respective secondary recrystallized grains were measured by the Laue method. Further, the product sheets were analyzed for metal components, and as a result thereof, As 0.04% and Bi 0.01% remained in the metals of the product sheets.

Shown together in Table 4 are measurement results of the linear groove forms, the secondary recrystallized grain forms, the grain directions and the magnetic characteristics (magnetic flux density $B_8$ and iron loss $W_{17/50}$) of the grain-oriented electrical steel sheet products prepared above.

TABLE 4

| Sample code | Shot blast treatment | Linear groove | Formation of forsterite | Shearing angle average value θ in crystallization direction (deg.) | Area percentage of secondary grains having a maximum width of 60 mm or more in rolling direction (%) | Area percentage of grains having a grain diameter of 2 to 20 mm (%) | Area percentage average β of grains having a grain diameter of 2 to 20 mm (deg.) | $B_8$ (T) | $W_{17/50}$ (W/kg) | Remarks |
|---|---|---|---|---|---|---|---|---|---|---|
| 4A | None | None | Done | 2.1 | 93 | 0.1 | 0.8 | 1.979 | 0.92 | Comp. Ex. |
| 4B | Done | None | Done | 2.1 | 91 | 5.1 | 3.2 | 1.962 | 0.78 | Example |
| 4C | None | None | None | 1.6 | 95 | 0.09 | 0.9 | 1.987 | 0.83 | Comp. Ex. |
| 4D | Done | None | None | 2.3 | 89 | 9.2 | 2.5 | 1.979 | 0.71 | Example |
| 4E | None | Done | Done | 2.6 | 96 | 0.15 | 1.3 | 1.932 | 0.76 | Comp. Ex. |
| 4F | Done | Done | Done | 2.7 | 88 | 8.3 | 2.2 | 1.935 | 0.65 | Example |
| 4G | None | Done | None | 1.6 | 94 | 0.13 | 1.0 | 1.942 | 0.67 | Comp. Ex. |
| 4H | Done | Done | None | 1.5 | 91 | 7.0 | 1.9 | 1.940 | 0.53 | Example |

Comp. Ex.: Comparative Example

As is apparent from the results shown in Table 4, all the grain-oriented electrical steel sheets prepared in the examples of the present invention have very excellent magnetic characteristics. In particular, among the steel sheets having no linear grooves (4A to 4D), the steel sheet of 4D having no forsterite coating achieves a particularly low iron loss. Among the steel sheets having linear grooves (4E to 4H), the steel sheet of 4H having no forsterite coating achieves a particularly low iron loss.

The present invention relates to the grain-oriented electrical steel sheet in which an average direction of secondary recrystallized grains is specified and in addition, with respect to an area rate of secondary recrystallized grains having a length of 60 mm or more in a rolling-orthogonal direction and micro grains, an area rate and a direction of crystal grains having a grain diameter of 2 to 20 mm are specified. In a grain-oriented electrical steel sheet of a high magnetic flux density ($B_8 \geqq 1.96$ T) in which it has so far been difficult to obtain stably a low iron loss without providing magnetic domain-refining treatment, a low iron loss can stably be obtained without providing magnetic domain-refining treatment. Further, an electrical steel sheet having a very low iron loss value can be obtained by magnetic domain refining by forming grooves on a steel sheet surface, smoothening of the steel sheet surface or combination thereof.

What is claimed is:

1. A grain-oriented electrical steel sheet having excellent magnetic characteristics, which sheet comprises:

about 2.0 to about 5.0 mass % of Si and about 0.0003 to about 0.1 mass % of one or the total of two or more kinds of As, Sb and Bi, and said sheet having secondary recrystallized grains in which shearing angles of grain directions [001] of said secondary recrystallized grains from the rolling direction of said sheet have an average value of about 4° or less, and wherein said secondary recrystallized grains having a maximum length of about 60 mm or more in the rolling-orthogonal direction have an area occupancy of about 85% or more; and said sheet having crystal grains having a grain diameter falling in a range of about 2–20 mm have an area occupancy of about 0.20–10%; and wherein the area average angle formed with said steel sheet surface by said grain directions [001] of said crystal grains is about 1.5°–5.0°.

2. The grain-oriented electrical steel sheet of claim 1, wherein linear grooves forming an angle of about 30° or less with the rolling-orthogonal direction of said sheet, and having a depth of about 10 μm or more and a width of about 20–300 μm are present in a group on said steel sheet surface, and are spaced apart from each other at spaces of about 1 mm or more.

3. The grain-oriented electrical steel sheet of claim 1 or 2, wherein final finishing annealed sheet has smooth metal surface.

4. The grain-oriented electrical steel sheet defined in claim 1, wherein said sheet surface has a non-uniformity of local magnetic flux (r), and wherein the degree of non-uniformity (r) taken by multiple probes in said steel sheet is about 0.15 or less, where the aforesaid non-uniformity (r) is defined by the following formula $$r = (1/N)\sum_{i=1}^{N}(B_i^{local} - B_m)/B_m \tag{2}$$

wherein N equals the number of probes utilized in the non-uniformity measurement, wherein $Bi^{local}$ is the local magnetic flux density and wherein Bm is the magnetic flux density of the entire sheet of said steel.

5. In a process for production of grain-oriented electrical steel sheet, which sheet comprises about 2.0 to about 5.0 mass % of Si and about 0.0003 to about 0.1 mass % of one or the total of two or more kinds of As, Sb and Bi, the steps which comprise:

(a) heating a silicon containing steel slab to about 1250° C. and subjecting it to hot rolling at a temperature of about 900° C. or higher to prepare a hot rolled sheet, (b) subjecting said hot rolled sheet to hot rolled sheet annealing at about 800 to about 1100° C. for about 20 to about 300 seconds, (c) subjecting said annealed sheet to cold rolling at a steel sheet temperature of about 150° C. or higher and a steel sheet tension at the roll outlet side of about 25 to 45 kg/mm$^2$ in at least one pass among two or more plural passes constituting cold rolling with intermediate annealing at about 800 to 1150° C. for about 20 to 300 seconds interposed between said passes, (d) then subjecting said cold rolled sheet to decarburization annealing at about 800 to about 900° C. for about 30 to about 200 seconds, (e) applying an annealing separator to said decarburization annealed sheet and then subjecting said sheet to final finishing annealing at a temperature of about 1130° C. or higher for about 5 hours or longer, and (f) providing said final finishing annealed sheet with an insulation coating.

6. In a process for production of grain-oriented electrical steel sheet which comprises about 2.0 to about 5.0 mass % of Si and about 0.0003 to about 0.1 mass % of one or the total of two or more kinds of As, Sb and Bi, the steps which comprise:

(a) heating a silicon containing steel slab to 1250° C. and then subjecting it to hot rolling at a temperature of about 900° C. or higher to prepare a hot rolled sheet, (b) subjecting said hot rolled sheet to hot rolled sheet annealing at about 800 to about 1100° C. for about 20 to about 300 seconds, (c) subjecting said hot annealed sheet to cold rolling at a steel sheet temperature of about 150° C. or higher in at least one pass among two or more plural passes constituting cold rolling with intermediate annealing at about 800 to about 1150° C. for about 20 to about 300 seconds interposed between said passes, (d) subjecting said cold rolled sheet to decarburization annealing at about 800 to about 900° C. for about 30 to about 200 seconds, (e) subjecting said annealed sheet surface to shot blasting and then applying an annealing separator thereon, (f) subjecting said steel sheet to final finishing annealing at a temperature of about 1130° C. or higher for about 5 hours or longer, and (g) providing said annealed sheet with an insulation coating.

7. The process defined in claim 5, further comprising the step of providing the surface of said cold rolled sheet, after said cold rolling and before applying said annealing separator with a linear groove group in which linear grooves forming an angle of about 30° or less with the rolling-orthogonal direction and having a depth of about 10 μm or more and a width of about 20 μm or more and about 300 μm or less are spaced apart from each other upon said steel at a space of about 1 mm or more.

8. The process defined in claim 6, further comprising the step of providing the surface of said cold rolled sheet, after said cold rolling and applying said annealing separator with a linear groove group in which linear grooves forming an angle of about 30° or less with the rolling-orthogonal direction and having a depth of about 10 μm or more and a width of about 20 μm or more and about 300 μm or less are spaced apart from each other upon said steel at a space of about 1 mm or more.

9. The process defined in claim 5, wherein said annealing separator comprises alumina as a principal component and is present at the step of applying said annealing separator.

10. The process defined in claim 6, wherein said annealing separator comprises alumina as a principal component and is present at the step of applying said annealing separator.

* * * * *

UNITED STATES PATENT AND TRADEMARK OFFICE

CERTIFICATE OF CORRECTION

PATENT NO. : 6,110,298
DATED : August 29, 2000
INVENTOR(S) : Senda et al

It is certified that error appears in the above-indentified patent and that said Letters Patent is hereby corrected as shown below:

In column 6, at line 50, please change "SB" to --5B--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*